US009187934B1

(12) United States Patent
Lee

(10) Patent No.: US 9,187,934 B1
(45) Date of Patent: Nov. 17, 2015

(54) SECURING DEVICE FOR A PORTABLE DEVICE

(71) Applicant: ABA UFO INTERNATIONAL CORP., New Taipei (TW)

(72) Inventor: Miko Lee, New Taipei (TW)

(73) Assignee: ABA UFO INTERNATIONAL CORP., New Taipei (TW)

( * ) Notice: Subject to any disclaimer, the term of this patent is extended or adjusted under 35 U.S.C. 154(b) by 0 days.

(21) Appl. No.: 14/736,135

(22) Filed: Jun. 10, 2015

(51) Int. Cl.
*E05B 73/00* (2006.01)

(52) U.S. Cl.
CPC ..... *E05B 73/0017* (2013.01); *E05B 73/0005* (2013.01); *E05B 73/0082* (2013.01); *Y10T 70/40* (2015.04); *Y10T 70/5009* (2015.04)

(58) Field of Classification Search
CPC . E05B 73/00; E05B 73/0005; E05B 73/0017; E05B 73/0082; Y10T 70/40; Y10T 70/5009
USPC ..... 70/14, 58; 361/679.57
See application file for complete search history.

(56) References Cited

U.S. PATENT DOCUMENTS 5,190,466 A * 3/1993 McVey ..... H01R 13/60 439/133
5,501,555 A * 3/1996 Muetschele ..... B25D 17/00 173/171
5,673,573 A * 10/1997 Green ..... G11B 33/005 292/91
5,992,187 A * 11/1999 Derman ..... E05B 67/003 70/30
6,449,992 B1 * 9/2002 Yu ..... E05B 73/0082 70/23
6,523,373 B1 * 2/2003 Su ..... E05B 73/0005 70/28
6,619,080 B1 * 9/2003 Yu ..... E05B 73/0005 70/14
6,619,081 B1 * 9/2003 Yu ..... E05B 73/0005 70/14
7,997,106 B2 * 8/2011 Mahaffey ..... E05B 73/0005 70/14
2003/0106349 A1 * 6/2003 Broadbridge ..... E05B 73/0005 70/58
2003/0200775 A1 * 10/2003 Yu ..... E05B 37/0003 70/58
2007/0175248 A1 * 8/2007 Wu ..... E05B 37/025 70/58
2010/0180648 A1 * 7/2010 Knox ..... E05B 73/0082 70/58

* cited by examiner

*Primary Examiner* — Lloyd Gall
(74) *Attorney, Agent, or Firm* — Pai Patent & Trademark Law Firm; Chao-Chang David Pai

(57) ABSTRACT

A securing device for a portable device has a lock assembly and a cable connected to the lock assembly. The lock assembly has two locking pins, two resilient elements, a slider, and a lock mounted in a housing. When the lock is rotated by a key, the lock drives the slider and the slider pushes the locking pins to slide laterally. Thus, the lock assembly can be fastened to a casing with a lock hole and with interior space laterally reserved beside the lock hole. The securing device secures the portable device regardless of thickness of the portable device.

20 Claims, 7 Drawing Sheets

SECURING DEVICE FOR A PORTABLE DEVICE

BACKGROUND OF THE INVENTION

1. Field of the Invention

The present invention relates to a securing device for a portable device, especially to a securing device that secures the portable device at a specific position.

2. Description of the Prior Art(s)

A computer cable lock device comprises a lock and a cable connected to the lock. The lock is for being fastened to a portable device, such as a laptop. With the cable looping around a post, such as a leg of a table, the portable device cannot be taken away from the post, thereby facilitating theft prevention.

A lock of a conventional computer cable lock device has a lock pin. The lock pin is T-shaped and has a cross-rod formed on a distal end of the lock pin. A housing of the portable device has an elongated lock hole transversely formed on the housing. The lock hole corresponds in shape and size to the cross-rod. When in use, the cross-rod is inserted into the housing through the elongated lock hole. Then a key for the lock drives the lock pin to turn by 90 degrees. Thus, the cross-rod is perpendicular to the elongated lock hole and abuts an inner surface of the housing. Accordingly, the lock of the conventional computer cable lock device is fastened to the portable device.

However, in order to allow the cross-rod of the lock pin to be inserted into the housing, a length of the elongated lock hole should be longer or equal to a length of the cross-rod. Moreover, interior space in the housing of the portable device and above and under the lock hole should be reserved for the cross-rod to be turned and abut the inner surface of the housing. As the portable device, such as the laptop, is developed toward the trend of getting thinner and thinner, the portable device would be too thin to allow the conventional computer cable lock device to be fastened to the portable device.

To overcome the shortcomings, the present invention provides a securing device for a portable device to mitigate or obviate the aforementioned problems.

SUMMARY OF THE INVENTION

The main objective of the present invention is to provide a securing device for a portable device. The securing device has a lock assembly and a cable connected to the lock assembly. The lock assembly has a housing and two locking pins, two resilient elements, a slider, and a lock mounted in the housing.

When the lock is rotated by a key, the lock drives the slider and the slider pushes the locking pins to slide laterally. Thus, the lock assembly can be fastened to a casing with a lock hole and with interior space laterally reserved beside the lock hole. The securing device secures the portable device regardless of thickness of the portable device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
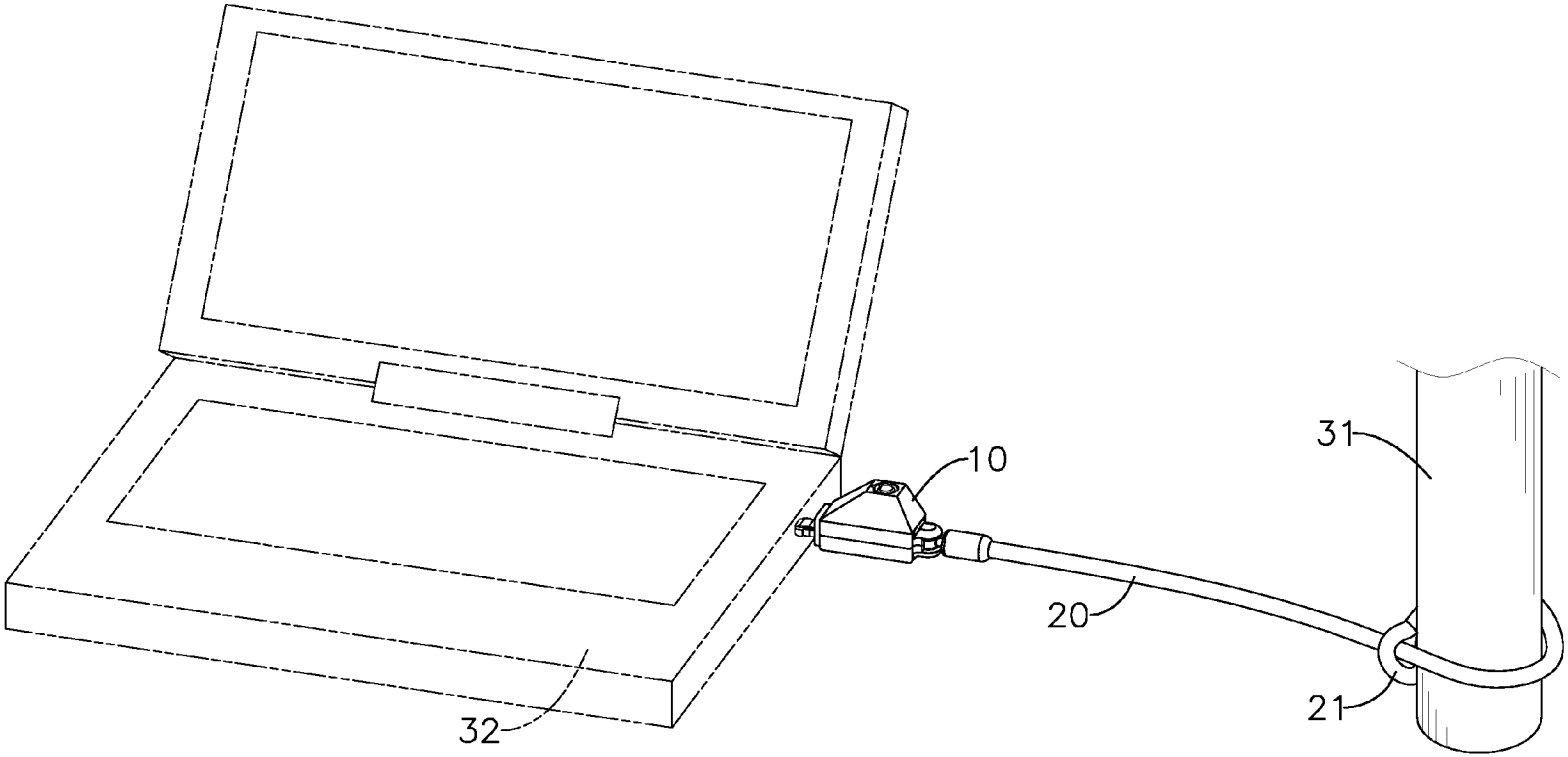
FIG. 1 is an operational perspective view of a securing device for a portable device in accordance with the present invention.
Figure 2:
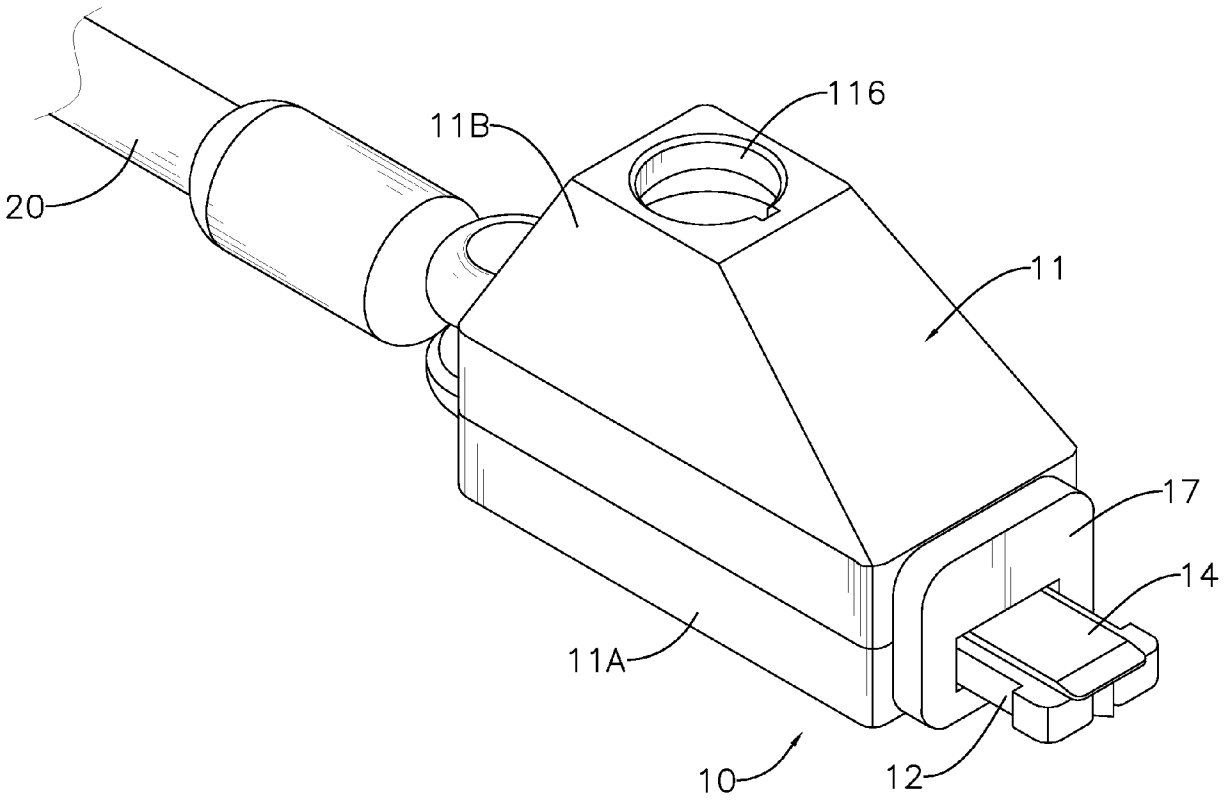
FIG. 2 is a perspective view of the securing device in FIG. 1.

With reference to FIGS. 1 and 2, a securing device for a portable device 32 in accordance with the present invention comprises a lock assembly 10 and a cable 20.

Figure 3:
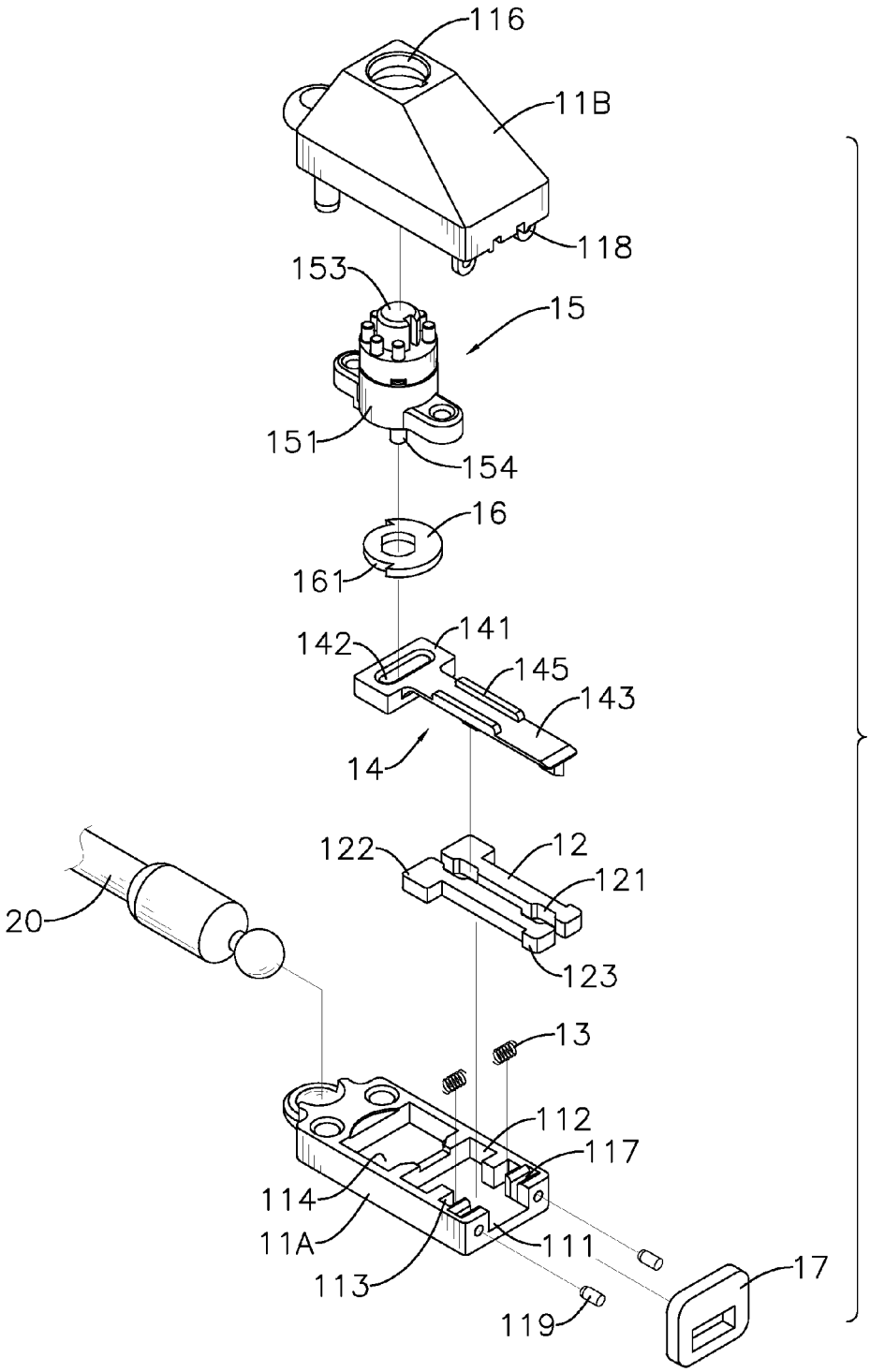
FIG. 3 is an exploded perspective view of the securing device in FIG. 1.

With further reference to FIG. 3, the lock assembly 10 includes a housing 11, two locking pins 12, two resilient elements 13, a slider 14, a lock 15, a limit ring 16, and a cushion pad 17.

Figure 4:
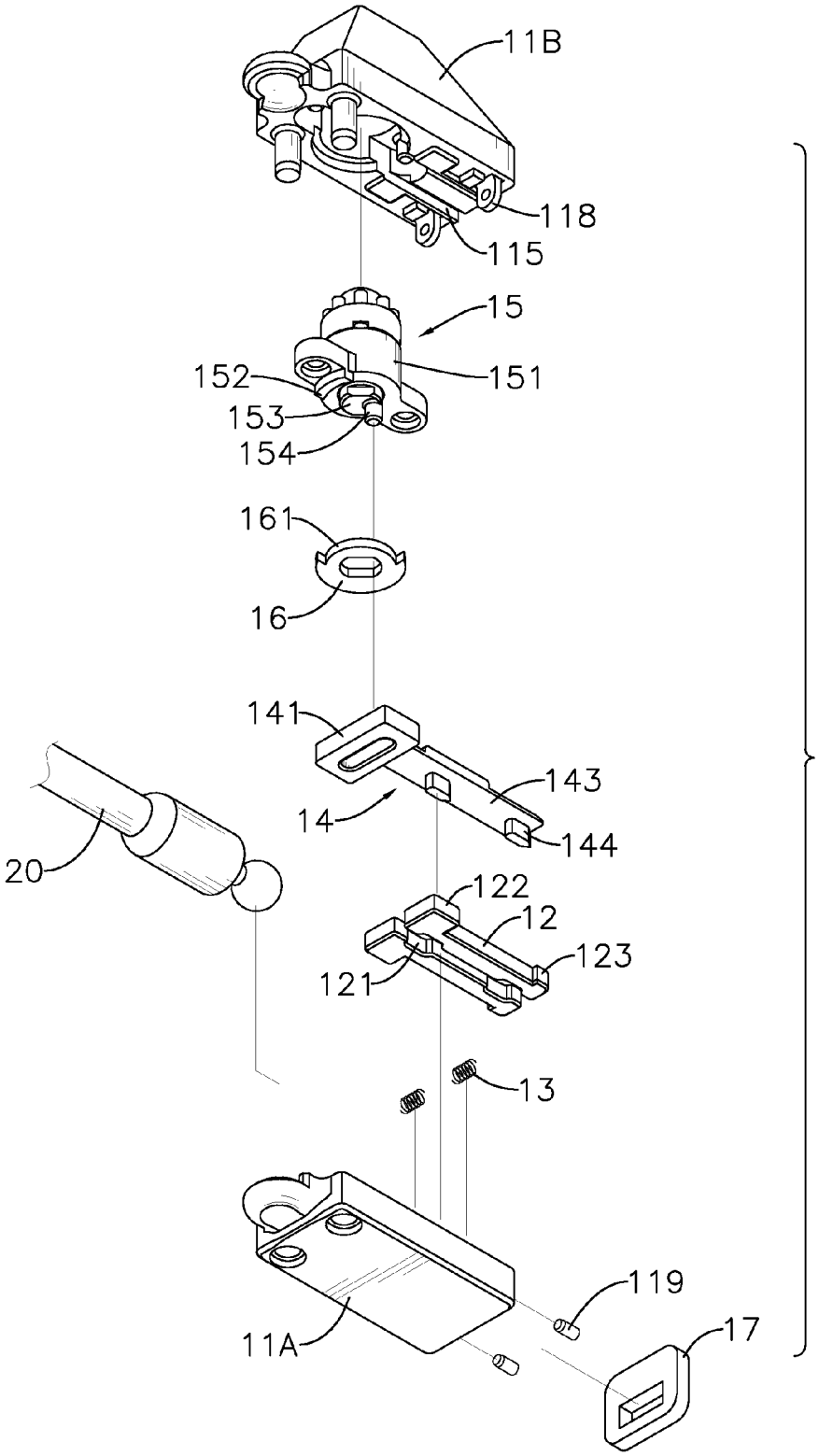
FIG. 4 is another exploded perspective view of the securing device in FIG. 1.

With further reference to FIG. 4, the housing 11 has a front end, a rear end, a top, a mounting recess 111, two inner sidewalls, two engaging recesses 112, two receiving recesses 113, a sliding recess 114, at least one guiding recess 115, and a keyhole 116.

The mounting recess 111 is formed in the housing 11 and through the front end of the housing 11. The inner sidewalls of the housing 11 are oppositely defined in the mounting recess 111. The engaging recesses 112 are respectively formed in the inner sidewalls of the housing 11 and correspond in position to each other. The receiving recesses 113 are respectively formed in the inner sidewalls of the housing 11 and correspond in position to each other.

The sliding recess 114 is formed in the housing 11 and is disposed between the mounting recess 111 and the rear end of the housing 11. The at least one guiding recess 115 is formed in the housing 11. Each of the at least one guiding recess 115 is elongated and has two opposite ends. The two ends of the guiding recess 115 are respectively positioned toward the front end of the housing 11 and the rear end of the housing 11. The keyhole 116 is formed through the top of the housing 11.

In the preferred embodiment, the housing 11 is formed by attaching a base 11A and a cover 11B. The base 11A has an inner surface, a front end, and a rear end. The mounting recess 111 is formed in the inner surface of the base 11A and through the front end of the base 11A. The inner sidewalls of the housing 11 are formed in the base 11A. The sliding recess 114 is formed in the inner surface of the base 11A and is disposed between the mounting recess 111 and the rear end of the base 11A. The cover 11B has a top, an inner surface, a front end, and a rear end. The inner surface of the cover 11B is opposite to the top of the cover 11B and faces the inner surface of the base 11A. The at least one guiding recess 115 is formed in the inner surface of the cover 11B. The two ends of each of the at least one guiding recess 115 are respectively positioned toward the front end of the cover 11B and the rear end of the cover 11B. The keyhole 116 is formed through the top of the cover 11B.

Preferably, the base 11A further has two insertion slots 117. The insertion slots 117 are respectively formed in the inner sidewalls of the housing 11 and are disposed by the front end of the base 11A. The cover 11B further has two tabs 118. The tabs 118 are formed on the inner surface of the cover 11B and are respectively inserted in the insertion slots 117 of the base 11A. Two fastening bars are mounted through the front end of the base 11A and are respectively mounted through the tabs 118, such that the base 11A and the cover 11B are securely connected with each other.

Figure 5:
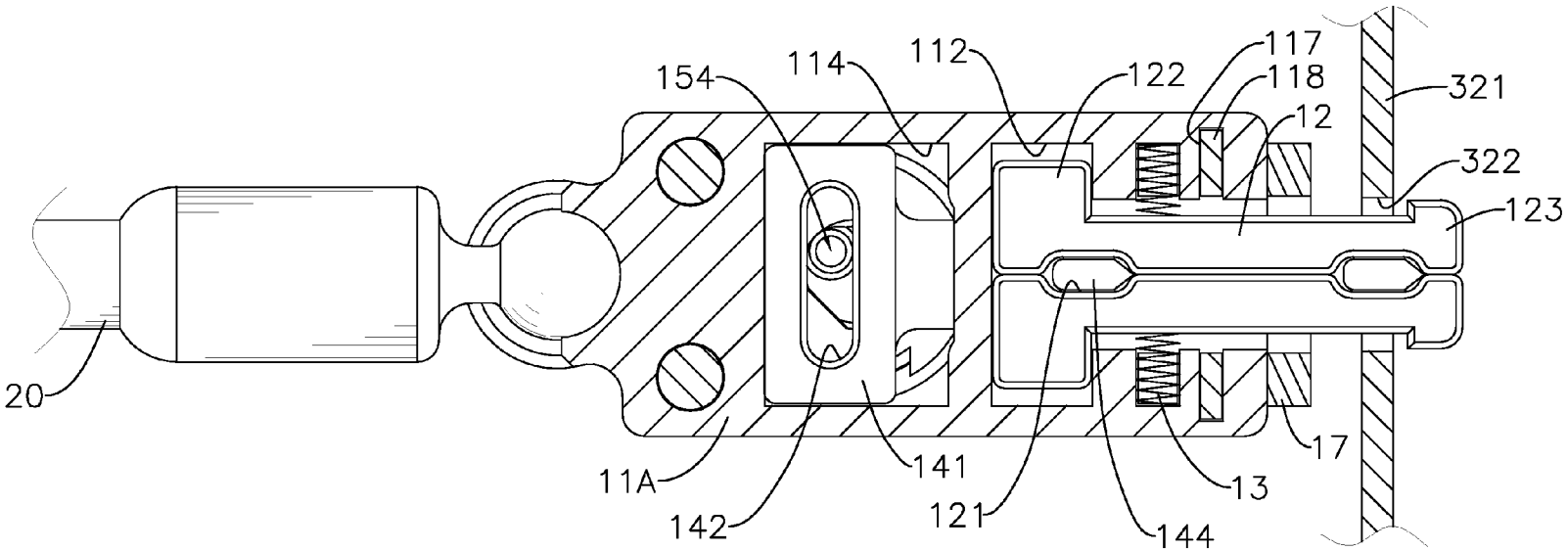
FIG. 5 is an operational bottom view in partial section of the securing device in FIG. 1.

With further reference to FIG. 5, the locking pins 12 are arranged side by side in the mounting recess 111 of the housing 11 and are slidable perpendicular to a line that extends through the front end of the housing 11 and the rear end of the housing 11. Each of the locking pins 12 is elongated and has a front end, an inner side, an outer side, at least one positioning recess 121, an engaging protrusion 122, and a locking protrusion 123. The front end of the locking pin 12 protrudes out of the housing 11 from the front end of the housing 11. The inner side of one of the locking pins 12 faces the inner side of the other locking pin 12. The at least one positioning recess 121 is formed in the inner side of the locking pin 12. Each of the at least one positioning recess 121 of one of the locking pins 12 corresponds in position to one of the at least one positioning recess 121 of the other locking pin 12 to define at least one pair of corresponding positioning recesses. The engaging protrusion 122 is formed on the outer side of the locking pin 12 and engages in a corresponding one of the engaging recesses 112 of the housing 11, such that the locking pin 12 is unable to slide along the line that extends through the front end of the housing 11 and the rear end of the housing 11. The locking protrusion 123 is formed on the outer side of the locking pin 12 adjacent to the front end of the locking pin 12. The locking protrusions 123 of the locking pins 12 protrude toward opposite directions.

The resilient elements 13 are respectively mounted in the receiving recesses 113 of the housing 11. Each of the resilient elements 13 has two ends respectively abutting the housing 11 and a corresponding one of the locking pins 12. Thus, the resilient elements 13 push the locking pins 12 to move toward each other. Specifically, each of the resilient elements 13 is a compression spring.

The slider 14 is mounted in the housing 11, is mounted between the base 11A and the cover 11B, and is slidable along the line that extends through the front end of the housing 11 and the rear end of the housing 11. The slider 14 has a head portion 141, a driving slot 142, and an extending panel 143.

The head portion 141 is mounted in the sliding recess 114 of the housing 11 and is slidable along the line that extends through the front end of the housing 11 and the rear end of the housing 11. The driving slot 142 is formed in the head portion 141.

The extending panel 143 protrudes from the head portion 141, extends toward the front end of the housing 11, and is mounted on the locking pins 12. The extending panel 143 has a rear end, a front end, a lower surface, an upper surface, at least one pushing protrusion 144, and at least one guiding protrusion 145. The rear end of the extending panel 143 is attached to the head portion 141. The front end of the extending panel 143 protrudes out of the housing 11 from the front end of the housing 11. The lower surface of the extending panel 143 faces the locking pins 12. The upper surface of the extending panel 143 faces the at least one guiding recess 115 of the housing 11. The at least one pushing protrusion 144 is formed on the lower surface of the extending panel 143 and protrudes between the locking pins 12. Each of the at least one pushing protrusion 144 selectively engages in a corresponding one of the at least one pair of corresponding positioning recesses 121 of the locking pins 12. The at least one guiding protrusion 145 is formed on the upper surface of the extending panel 143 and is slidably mounted in the at least one guiding recess 115 of the housing 11, such that the slider 14 can slide relative to the housing 11 along the at least one guiding recess 115.

In the preferred embodiment, the housing 11 has two guiding recesses 115. The guiding recesses 115 are separately formed in the inner surface of the cover 11B and are parallel to each other. Each of the locking pins 12 has two positioning recesses 121. The positioning recesses 121 are separately formed in the inner side of the locking pin 12. Accordingly, two pairs of corresponding positioning recesses 121 are formed. The extending panel 143 of the slider 14 has two pushing protrusions 144 and two guiding protrusions 145 The pushing protrusions 144 are separately formed on the lower surface of the extending panel 143 and selectively engage in the two pairs of corresponding positioning recesses 121 of the locking pins 12 respectively. The guiding protrusions 145 are separately formed on the upper surface of the extending panel 143. The guiding protrusions 145 are respectively mounted in the guiding recesses 115.

Figure 7:
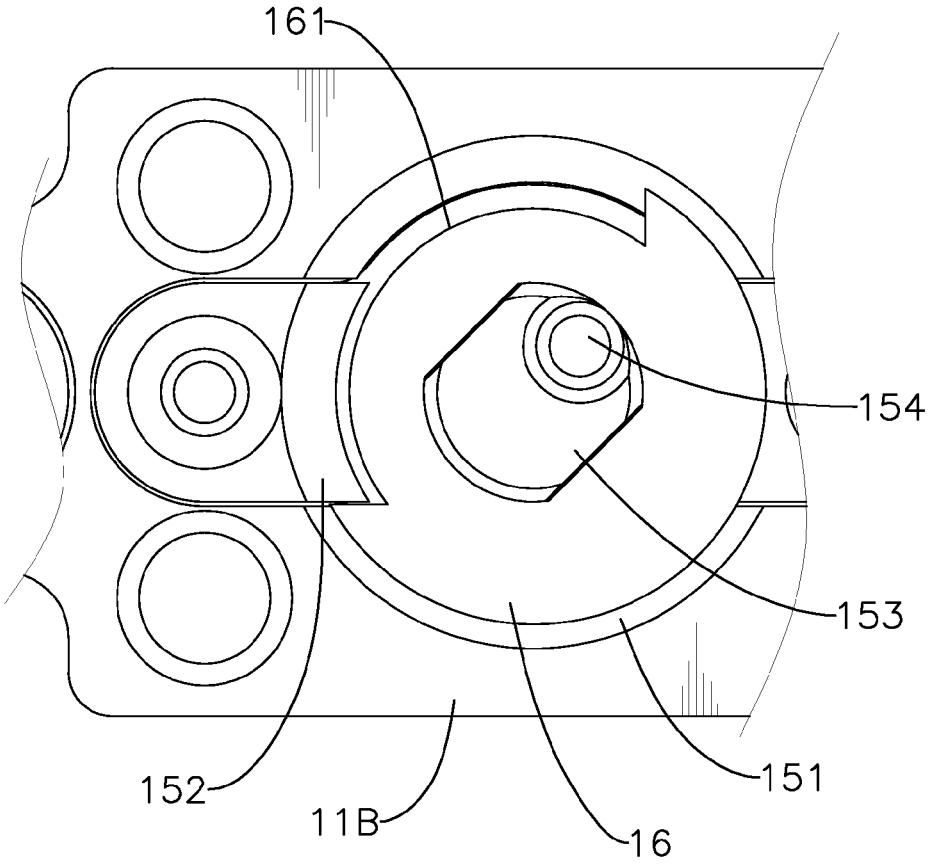
FIG. 7 is an enlarged bottom view of the securing device in FIG. 1.

With further reference to FIG. 7, the lock 15 is mounted in the housing 11 and is mounted in the cover 11B of the housing 11. The lock 15 has an inner end and a driving rod 154. The driving rod 154 protrudes from the inner end of the lock 15, is mounted in the driving slot 142 of the head portion 141 of the slider 14, and selectively drives the slider 14 to slide along the line that extends through the front end of the housing 11 and the rear end of the housing 11.

In the preferred embodiment, the lock 15 includes a lower seat 151 and a lock core 153. The lower seat 151 is securely mounted in the cover 11B of the housing 11, and has a lower end surface and a limiting protrusion 152. The lower end surface of the lower seat 151 faces the head portion 141 of the slider 14. The limiting protrusion 152 protrudes from the lower end surface of the lower seat 151. The lock core 153 is rotatably mounted through the lower seat 151 and has an outer end and an inner end. The outer end of the lock core 153 protrudes in the keyhole 116 of the housing 11. The driving rod 154 of the lock 15 protrudes from the inner end of the lock core 153 and is positioned eccentric to the lock core 153. When a key drives the lock core 153 to rotate, the driving rod 154 drives the slider 14 to slide along the line that extends through the front end of the housing 11 and the rear end of the housing 11.

The limit ring 16 is mounted between the head portion 141 of the slider 14 and the lower seat 151, and is mounted around and securely attached to the inner end of the lock core 153. The limit ring 16 has a limiting recess 161. The limiting recess 161 is arced, is formed in an outer peripheral edge of the limit ring 16, and receives the limiting protrusion 152 of the lower seat 151. Thus, a rotating range of the lock core 153 is limited.

The cushion pad 17 is attached to the front end of the housing 11. The front ends of the locking pins 12 and the front end of the extending panel 143 of the slider 14 protrude through the cushion pad 17. Specifically, the cushion pad 17 may be made of foam materials.

The cable 20 is connected to the housing 11 and has a distal end, a proximal end, and a lasso 21. The proximal end of the cable 20 is connected to the rear end of the housing 11. The lasso 21 is formed on the distal end of the cable 20.

With reference to FIGS. 1, 2, and 5, when in use, the cable 20 is looped around a post 31 and the lock assembly 10 is mounted through the lasso 21 of the cable 20. Then a key is inserted into the keyhole 116 of the housing 11 and is turned to drive the lock core 153 to rotate. Thus, the driving rod 154 drives the slider 14 to allow the pushing protrusions 144 of the slider 14 to respectively engage in the pairs of corresponding positioning recesses 121 of the locking pins 12. Meanwhile, the resilient elements 13 push the locking pins 12, such that the inner sides of the locking pins 12 abut against each other.

Accordingly, the front ends of the locking pins 12 can be inserted into a lock hole 322 formed on a casing 321 of the portable device 32.

Figure 6:
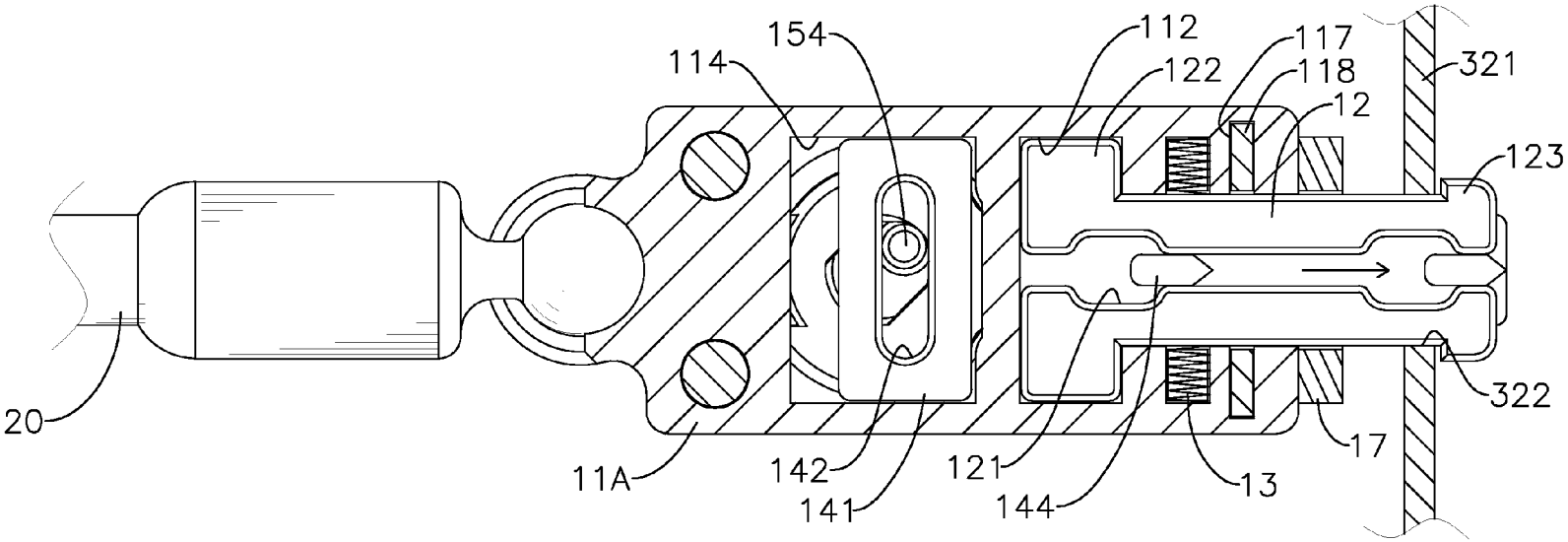
FIG. 6 is another operational bottom view in partial section of the securing device in FIG. 1.

With further reference to FIG. 6, when the key is further turned, the driving rod 154 drives the slider 14, such that the pushing protrusions 144 disengage from the positioning recesses 121 of the locking pins 12 and are held by the inner sides of the locking pins 12. Thus, a distance defined between the outer sides of the locking pins 12 is enlarged. Accordingly, the locking protrusions 123 of the locking pins 12 abut against an inner surface of the casing 321 of the portable device 32, so the lock assembly 10 is fastened to the portable device 32. The cushion pad 17 prevents the housing 11 of the lock assembly 10 from hitting the casing 321 of the portable device 32.

The lock assembly 10 can be fastened to the casing 321 with a lock hole 322 and with interior space laterally reserved beside the lock hole 321. The securing device secures the portable device 32 regardless of thickness of the portable device Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A securing device for a portable device comprising:

a lock assembly including a housing having a front end;

a rear end;

a mounting recess formed in the housing and through the front end of the housing;

two inner sidewalls oppositely defined in the mounting recess;

two receiving recesses respectively formed in the inner sidewalls of the housing; and a sliding recess formed in the housing and disposed between the mounting recess and the rear end of the housing;

two locking pins arranged side by side in the mounting recess of the housing, being slidable perpendicular to a line that extends through the front end of the housing and the rear end of the housing, and being unable to slide along the line that extends through the front end of the housing and the rear end of the housing, each of the locking pins being elongated and having a front end protruding out of the housing from the front end of the housing;

an inner side;

an outer side;

at least one positioning recess formed in the inner side of the locking pin, each of the at least one positioning recess of one of the locking pins corresponding in position to one of the at least one positioning recess of the other locking pin to define at least one pair of corresponding positioning recesses; and a locking protrusion formed on the outer side of the locking pin adjacent to the front end of the locking pin;

two resilient elements respectively mounted in the receiving recesses of the housing, each of the resilient elements having two ends respectively abutting the housing and a corresponding one of the locking pins to push the locking pins to move toward each other;

a slider mounted in the housing and having a head portion mounted in the sliding recess of the housing and being slidable along the line that extends through the front end of the housing and the rear end of the housing;

a driving slot formed in the head portion; and an extending panel protruding from the head portion, extending toward the front end of the housing, and mounted on the locking pins, the extending panel having a rear end attached to the head portion;

a front end protruding out of the housing from the front end of the housing;

a lower surface; and at least one pushing protrusion formed on the lower surface of the extending panel and protruding between the locking pins, each of the at least one pushing protrusion selectively engaging in a corresponding one of the at least one pair of corresponding positioning recesses of the locking pins; and a lock mounted in the housing and having a driving rod, the driving rod mounted in the driving slot of the head portion of the slider and selectively driving the slider to slide along the line that extends through the front end of the housing and the rear end of the housing; and a cable connected to the housing.

2. The securing device as claimed in claim 1, wherein the lock assembly further includes a cushion pad, and the cushion pad is attached to the front end of the housing; and the front ends of the locking pins and the front end of the extending panel of the slider protrude through the cushion pad.

3. The securing device as claimed in claim 1, wherein the housing further has at least one guiding recess, the at least one guiding recess is formed in the housing, and each of the at least one guiding recess is elongated and has two opposite ends respectively positioned toward the front end of the housing and the rear end of the housing;

the extending panel of the slider further has an upper surface; and at least one guiding protrusion formed on the upper surface of the extending panel and slidably mounted in the at least one guiding recess of the housing.

4. The securing device as claimed in claim 2, wherein the housing further has at least one guiding recess, the at least one guiding recess is formed in the housing, and each of the at least one guiding recess is elongated and has two opposite ends respectively positioned toward the front end of the housing and the rear end of the housing;

the extending panel of the slider further has an upper surface; and at least one guiding protrusion formed on the upper surface of the extending panel and slidably mounted in the at least one guiding recess of the housing.

5. The securing device as claimed in claim 1, wherein the lock includes a lower seat securely mounted in the housing; and a lock core rotatably mounted through the lower seat and having an inner end; and the driving rod of the lock protrudes from the inner end of the lock core and is positioned eccentric to the lock core.

6. The securing device as claimed in claim 2, wherein the lock includes a lower seat securely mounted in the housing; and a lock core rotatably mounted through the lower seat and having an inner end; and the driving rod of the lock protrudes from the inner end of the lock core and is positioned eccentric to the lock core.

7. The securing device as claimed in claim 3, wherein the lock includes a lower seat securely mounted in the housing; and a lock core rotatably mounted through the lower seat and having an inner end; and the driving rod of the lock protrudes from the inner end of the lock core and is positioned eccentric to the lock core.

8. The securing device as claimed in claim 4, wherein the lock includes a lower seat securely mounted in the housing; and a lock core rotatably mounted through the lower seat and having an inner end; and the driving rod of the lock protrudes from the inner end of the lock core and is positioned eccentric to the lock core.

9. The securing device as claimed in claim 5, wherein the lock assembly further includes a limit ring mounted between the head portion of the slider and the lower seat, and mounted around and securely attached to the inner end of the lock core, and the limit ring has a limiting recess being arced and formed in an outer peripheral edge of the limit ring; and the lower seat of the lock has a lower end surface and a limiting protrusion, and the limiting protrusion protrudes from the lower end surface of the lower seat and protrudes in the limiting recess of the limit ring.

10. The securing device as claimed in claim 6, wherein the lock assembly further includes a limit ring mounted between the head portion of the slider and the lower seat, and mounted around and securely attached to the inner end of the lock core, and the limit ring has a limiting recess being arced and formed in an outer peripheral edge of the limit ring; and the lower seat of the lock has a lower end surface and a limiting protrusion, and the limiting protrusion protrudes from the lower end surface of the lower seat and protrudes in the limiting recess of the limit ring.

11. The securing device as claimed in claim 7, wherein the lock assembly further includes a limit ring mounted between the head portion of the slider and the lower seat, and mounted around and securely attached to the inner end of the lock core, and the limit ring has a limiting recess being arced and formed in an outer peripheral edge of the limit ring; and the lower seat of the lock has a lower end surface and a limiting protrusion, and the limiting protrusion protrudes from the lower end surface of the lower seat and protrudes in the limiting recess of the limit ring.

12. The securing device as claimed in claim 8, wherein the lock assembly further includes a limit ring mounted between the head portion of the slider and the lower seat, and mounted around and securely attached to the inner end of the lock core, and the limit ring has a limiting recess being arced and formed in an outer peripheral edge of the limit ring; and the lower seat of the lock has a lower end surface and a limiting protrusion, and the limiting protrusion protrudes from the lower end surface of the lower seat and protrudes in the limiting recess of the limit ring.

13. The securing device as claimed in claim 11, wherein the housing further has two engaging recesses respectively formed in the inner sidewalls of the housing and corresponding in position to each other; and each of the locking pins further has an engaging protrusion formed on the outer side of the locking pin and engaging in a corresponding one of the engaging recesses of the housing.

14. The securing device as claimed in claim 12, wherein the housing further has two engaging recesses respectively formed in the inner sidewalls of the housing and corresponding in position to each other; and each of the locking pins further has an engaging protrusion formed on the outer side of the locking pin and engaging in a corresponding one of the engaging recesses of the housing.

15. The securing device as claimed in claim 13, wherein the housing is formed by attaching a base and a cover, the base has an inner surface, a front end, and a rear end, the cover has an inner surface, a front end, and a rear end, and the inner surface of the cover faces the inner surface of the base;

the mounting recess is formed in the inner surface of the base and through the front end of the base;

the sliding recess is formed in the inner surface of the base and is disposed between the mounting recess and the rear end of the base; and the at least one guiding recess is formed in the inner surface of the cover, and the ends of each of the at least one guiding recess are respectively positioned toward the front end of the cover and the rear end of the cover.

16. The securing device as claimed in claim 14, wherein the housing is formed by attaching a base and a cover, the base has an inner surface, a front end, and a rear end, the cover has an inner surface, a front end, and a rear end, and the inner surface of the cover faces the inner surface of the base;

the mounting recess is formed in the inner surface of the base and through the front end of the base;

the sliding recess is formed in the inner surface of the base and is disposed between the mounting recess and the rear end of the base; and the at least one guiding recess is formed in the inner surface of the cover, and the ends of each of the at least one guiding recess are respectively positioned toward the front end of the cover and the rear end of the cover.

17. The securing device as claimed in claim 5, wherein the housing further has a keyhole formed through a top of the housing; and an outer end of the lock core protrudes in the keyhole of the housing.

18. The securing device as claimed in claim 8, wherein the housing further has a keyhole formed through a top of the housing; and an outer end of the lock core protrudes in the keyhole of the housing.

19. The securing device as claimed in claim 1, wherein the cable has a distal end;

a proximal end connected to the rear end of the housing; and a lasso formed on the distal end of the cable.

20. The securing device as claimed in claim 4, wherein the cable has a distal end;

a proximal end connected to the rear end of the housing; and a lasso formed on the distal end of the cable.

* * * * *